United States Patent [19]

Olson

[11] Patent Number: 4,739,877

[45] Date of Patent: Apr. 26, 1988

[54] COMBINATION KEY RING AND CARD HOLDER

[76] Inventor: David V. Olson, 929 Medical Arts Bldg., Minneapolis, Minn. 55402

[21] Appl. No.: 6,916

[22] Filed: Jan. 27, 1987

[51] Int. Cl.[4] ..... A45C 11/18; G08B 3/10

[52] U.S. Cl. ..... 206/38.1; 150/900; 206/39

[58] Field of Search ..... 40/10 A, 10 D, 10 R, 40/330; 150/900, 129; 206/37, 37.1, 37.4, 38, 38.1, 39; 383/43, 112; 70/456 R

[56] References Cited

U.S. PATENT DOCUMENTS

| | | | |
|---|---|---|---|
| 969,954 | 9/1910 | Holmes | 383/43 |
| 1,699,865 | 1/1929 | Walton . | |
| 2,061,375 | 11/1936 | Cramer | 383/112 |
| 2,177,786 | 10/1939 | Roemig . | |
| 2,270,015 | 1/1942 | Wright . | |
| 2,313,485 | 3/1943 | Stiller | 150/900 |
| 2,909,203 | 10/1959 | Reaves | 150/900 |
| 3,160,186 | 12/1964 | Conley | 206/38.1 |
| 3,353,579 | 11/1967 | Betcher et al. | 150/900 |

FOREIGN PATENT DOCUMENTS

| | | | |
|---|---|---|---|
| 0553863 | 6/1943 | United Kingdom | 206/39 |

*Primary Examiner*—Jimmy G. Foster
*Attorney, Agent, or Firm*—Burd, Bartz & Gutenkauf

[57] ABSTRACT

A combination key ring and card holder comprised of a padded stretchable protective pouch for credit cards or similar plastic cards to which a standard key ring is attached by a tab to one end. The pouch is adapted to hold one or more standard sized credit cards or similar cards which are inserted into the pouch through a slot which is shorter than the corresponding dimension of the card. The slot must be stretched to permit entry or removal of a card. Because the slot is shorter than the card, the card is firmly and protectively retained within the pouch.

14 Claims, 1 Drawing Sheet

COMBINATION KEY RING AND CARD HOLDER

BACKGROUND OF THE INVENTION

1. Field of the Invention

This invention relates to the combination of a key ring with a padded stretchable protective holder for plastic credit cards and similar plastic cards, such as automatic teller cards, security access cards, and the like.

Plastic credit cards are in universal use. Most adults in the United States carry from two or three to a dozen or more cards with which they charge to their accounts meals, hotel and motel rooms, gasoline purchases, department store purchases, and the like. Most such cards are carried in a wallet or a card case designed for holding cards, or the like. A major problem with frequently used credit cards is their susceptibility to wear and tear. Actual breakage often occurs. However, more commonly the raised identifying letters and numbers become abraded. When severely abraded, the cards no longer function. It is the principal object of the present invention to provide a simple, convenient, protective holder for those credit cards most frequently used, combined with a conventional key ring.

2. The Prior Art

Numerous wallets, pouches, envelopes and similar containers for credit cards, drivers licenses, etc. have been available. Most of these have been made of leather or leather substitutes such as vinyl resin, polyethylene, or the like. The combination of a key holder with a holder for a document such as drivers license, I.D. cards, etc. are known. Walton U.S. Pat. No. 1,699,865, Wright U.S. Pat. No. 2,270,015 and Roemig U.S. Pat. No. 2,177,786 are exemplary. However, none of these discloses or suggests the use of a padded protective stretch fabric pouch for holding cards, in combination with a key ring.

SUMMARY OF THE INVENTION

Broadly stated, the combination key ring and protective card holder of the present invention copmrises a flat, generally rectangular, flexible pouch adapted to contain at least one flat, generally rectangular, rigid or semi-rigid card. The pouch is of a size adated to receive a plurality of such cards in abutting, face-to-face relationship, and is composed of a pair of panels of padded stretchable sheet material. A slot is provided in the pouch to permit insertion and removal of the cards. The slot is of a length shorter than the corresponding dimension of the card such that the slot must be stretched to permit entry or removal of a card. A loop is attached to one end of the pouch. A split flat spiral spring key-holding ring engages that loop.

BRIEF DESCRIPTION OF THE DRAWINGS

The invention is illustrated in the accompanying drawings in which corresponding parts are identified by the same numerals and in which.

DETAILED DESCRIPTION OF THE PREFERRED EMBODIMENT

Figure 1:
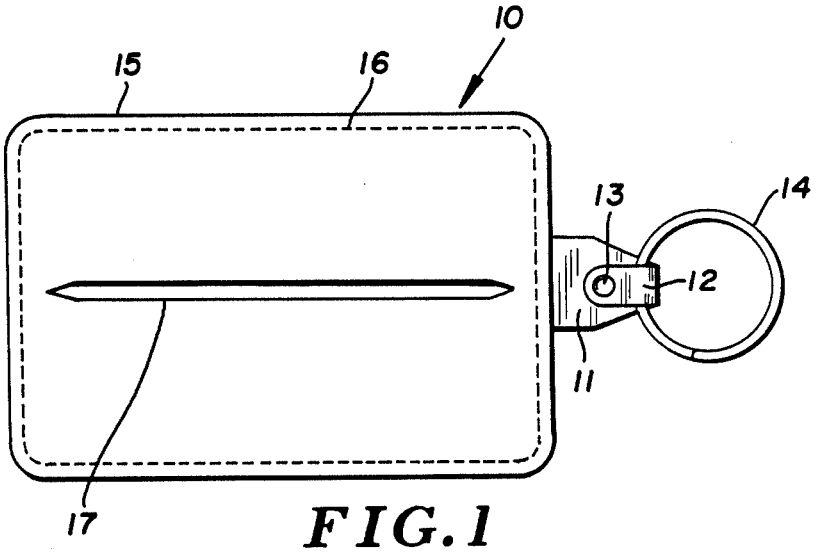
FIG. 1 is a plan view of a combination key ring and card holder according to the present invention.
Figure 2:
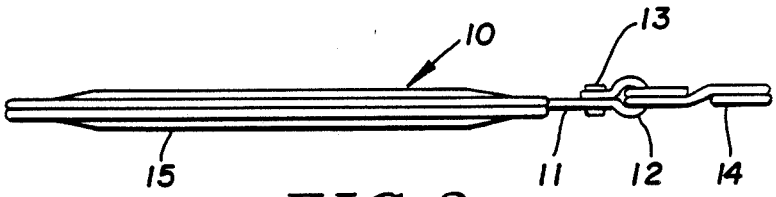
FIG. 2 is a side elevation thereof.
Figure 3:
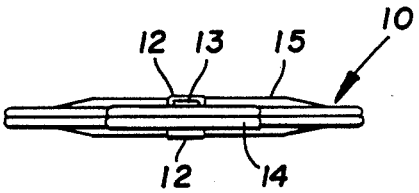
FIG. 3 is an end elevation thereof.

Referring now to the drawings, the combination key ring and card holder according to the present invention, as illustrated, is comprised of a card-holding pouch, indicated generally at 10, to which is attached a flat tab-like element 11 having a loop 12 adjacent one edge. As illustrated, the loop is formed by a tab folded back upon itself and secured, as by means of a rivet 13. A split flat spiral spring key-holding ring 14 of conventional structure, such as is commonly used in key rings, engages loop 12. Tab-like element 11 is formed of durable material such as synthetic resinous sheet material, or molded plastic, or leather, or textile fabric, or the like. The material should be capable of withstanding the frequent handling and wear and tear to which key rings are normally subjected.

Pouch 10 is of generally rectangular configuration corresponding to that of a standard sized plastic credit or identification card and of a size adapted to receive and contain a plurality of such cards in stacked abutting face-to-face relationship. The pouch 10 is longer than it is wide and the tab-like element 13 is secured to one narrow end of the pouch. The pouch 10 is composed of a pair of panels 15 of stretchable sheet material. The panels 15 are secured together in stacked abutting back-to-back relationship and are secured together as by stitching 16, heat sealing around the periphery, or the like.

A slot 17 is provided for insertion and removal of cards into and from the pouch. As shown, slot 17 is shown extending lengthwise in the middle of one side of one pouch panel 15. The slot 17 is of a length shorter than the length of a card to be contained within the pouch. The slot must be stretched to permit entry or removal of a card. Because the slot is shorter than the card, the card is securely retained within the pouch.

Slot 17 need not be centrally located as illustrated, but may be adjacent to or in one of the longer side edges of the pouch. Alternatively, the slot may extend crosswise of the pouch and be located near or at the end of the pouch opposite from the key ring. In this latter instance, the slot is of a length which is shorter than the width of the card, so that the slot must be stretched in order to permit entry of a card.

Panels 15 of pouch 10 may be cut from any durable commercially available stretchable flexible sheet material. This may be a stretchable textile fabric or a synthetic rubber of synthetic resinous rubber-like flexible sheet material. Preferably, however, the pouch panels are formed from outer textile fabric sheet material bonded or otherwise laminated to inner neoprene sheet material. The outer textile fabric can provide a pouch of attractive appearance and comfortable feel while the neoprene lining provides protective padding for the cards contained within the pouch. An advertising message or other indicia may be silk screened or otherwise imprinted on either or both outer faces of the pouch panels.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. In combination, a card and protective card holder comprising:

(A) a flat generally rectangular flexible pouch containing at least one flat generally rectangular rigid or semi-rigid card, said pouch being of a size adapted to receive a plurality of such cards in abutting face-to-face relationship and composed of a pair of panels of stretchable sheet material, and (B) a slot in said pouch to permit insertion and removal of said cards, said slot being of a length shorter than the corresponding dimension of the card such that the slot must be stretched to permit entry or removal of a card.

2. The combination according to claim 1 wherein the slot extends lengthwise of the pouch and is shorter than the length of a card to be contained therein.

3. The combination according to claim 2 wherein the slot is centrally disposed between the side edges of one of the panels of the pouch.

4. The combination according to claim 1 wherein the slot extends crosswise of the pouch and is shorter than the width of a card to be contained therein.

5. The combination according to claim 4 wherein the slot is disposed in one of the panels of the pouch adjacent to one end.

6. The combination according to claim 1 wherein the pouch is padded.

7. The combination according to claim 6 wherein the panels of the pouch are composed of exterior textile fabric bonded to inner neoprene synthetic rubber sheet material.

8. In combination, a key ring, a card and a protective holder for said card comprising:

(A) a flat generally rectangular flexible pouch containing at least one flat generally rectangular rigid or semi-rigid card, said pouch being of a size adapted to receive a plurality of such cards in abutting face-to-face relationship and composed of a pair of panels of stretchable sheet material.

(B) a slot in said pouch to permit insertion and removal of said cards, said slot being of a length shorter than the corresponding dimension of the card such that the slot must be stretched to permit entry or removal of a card, (C) a loop attached to one end of said pouch, and (D) a split flat spiral spring key-holding ring engaging said loop.

9. The combination according to claim 8 wherein the slot extends lengthwise of the pouch and is shorter than the length of a card to be contained therein.

10. The combination according to claim 9 wherein the slot is centrally disposed between the side edges of one of the panels of the pouch.

11. The combination according to claim 8 wherein the slot extends crosswise of the pouch and is shorter than the width of a card to be contained therein.

12. The combination according to claim 11 wherein the slot is disposed in one of the panels of the pouch adjacent to the end opposite from the key-holding ring.

13. The combination according to claim 8 wherein the pouch is padded.

14. The combination according to claim 13 wherein the panels of the pouch are composed of exterior textile fabric bonded to inner neoprene synthetic rubber sheet material.

* * * * *

UNITED STATES PATENT AND TRADEMARK OFFICE

CERTIFICATE OF CORRECTION

PATENT NO. : 4,739,877

DATED : April 26, 1988

INVENTOR(S) : David V. Olson

It is certified that error appears in the above-identified patent and that said Letters Patent is hereby corrected as shown below:

Column 1, line 42, "copmrises" should be --comprises--.

Column 1, line 45, "adated" should be --adapted--.

Signed and Sealed this

Twentieth Day of December, 1988

*Attest:*

DONALD J. QUIGG

*Attesting Officer*

*Commissioner of Patents and Trademarks*